US011117716B2

(12) United States Patent
Fosse

(10) Patent No.: US 11,117,716 B2
(45) Date of Patent: Sep. 14, 2021

(54) TAMPER EVIDENT CONTAINER

(71) Applicant: Lindar Corporation, Baxter, MN (US)

(72) Inventor: Daniel K. Fosse, Cambridge, MN (US)

(73) Assignee: Lindar Corp., Baxter, MN (US)

( * ) Notice: Subject to any disclaimer, the term of this patent is extended or adjusted under 35 U.S.C. 154(b) by 95 days.

(21) Appl. No.: 16/390,354

(22) Filed: Apr. 22, 2019

(65) Prior Publication Data

US 2019/0241328 A1 Aug. 8, 2019

Related U.S. Application Data

(63) Continuation of application No. 15/282,191, filed on Sep. 30, 2016, now Pat. No. 10,266,312.

(51) Int. Cl.
*B65D 43/22* (2006.01)
*B65D 43/16* (2006.01)

(52) U.S. Cl.
CPC ..... *B65D 43/22* (2013.01); *B65D 43/162* (2013.01); *B65D 2401/15* (2020.05); *B65D 2543/0062* (2013.01); *B65D 2543/00194* (2013.01); *B65D 2543/00296* (2013.01); *B65D 2543/00361* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 43/0256; B65D 43/22; B65D 2543/00324; B65D 17/08; B65D 17/347; B65D 43/161; B65D 43/162; B65D 2543/00833
See application file for complete search history.

(56) References Cited

U.S. PATENT DOCUMENTS

| | | | |
|---|---|---|---|
| 4,986,438 | A | 1/1991 | Borst |
| 7,073,680 | B2 | 7/2006 | Boback et al. |
| 7,118,003 | B2 | 10/2006 | Sellari et al. |
| 7,243,813 | B2 | 7/2007 | Krueger |
| D698,241 | S | 1/2014 | Fosse |
| 8,807,385 | B1 | 8/2014 | Fosse |
| 2003/0121917 | A1 | 7/2003 | Fore et al. |
| 2008/0087669 | A2 | 4/2008 | Boback et al. |
| 2009/0206082 | A1 | 8/2009 | Vovan |
| 2010/0140267 | A1 | 6/2010 | Sellari et al. |
| 2011/0056976 | A1 | 3/2011 | Chen |
| 2012/0103990 | A1 | 5/2012 | McCumber |
| 2014/0027458 | A1 | 1/2014 | Liu |
| 2014/0209607 | A1 | 7/2014 | Fosse |

(Continued)

OTHER PUBLICATIONS http://www.inlineplastics.com/safe_t_fresh.php Inline Plastics Corporation.

(Continued)

*Primary Examiner* — Andrew T Kirsch
(74) *Attorney, Agent, or Firm* — Skaar Ulbrich Macari, P.A.

(57) ABSTRACT

A tamper evident closure includes a first snap, a cover, a tear strip connected to the cover, and a second snap connected to the tear strip. In a closed position, a cavity of the cover is configured to be placed over the first snap, and the second snap is configured to be placed in and engaged with a cavity in the first snap. In a closed position, there is a gap between the first snap and the cover.

13 Claims, 8 Drawing Sheets

(56) References Cited

U.S. PATENT DOCUMENTS

| | | | | |
|---|---|---|---|---|
| 2015/0060454 | A1* | 3/2015 | Kowal | B65D 43/24 220/269 |
| 2017/0283139 | A1 | 10/2017 | Fosse | |
| 2017/0361980 | A1 | 12/2017 | Fosse | |

OTHER PUBLICATIONS http://www.dartcontainer.com/web/products.nsf/files/M-204.pdf/$FILE/M-204.pdf Dart Container Corporation.
http://www.parpak.com/brochures/BreakAway-OCT10-ENG.pdf Par-Pak Corporation, Oct. 2010.
http://www.pactiv.com/products_na/foodservice/data/PWPTamperEvident.pdf PACTIV Foodservice/Food Packaging.
http://www.pactiv.com/Products_NA/Foodservice/data/TESquares.pdf PACTIV Foodservice/Food Packaging.

* cited by examiner

TAMPER EVIDENT CONTAINER

CROSS-REFERENCE TO RELATED APPLICATION(S)

This application is a continuation of U.S. application Ser. No. 15/282,191 filed Sep. 30, 2016, and entitled "TAMPER EVIDENT CONTAINER," the disclosure of which is incorporated by reference in its entirety.

BACKGROUND

The present invention relates to containers, and in particular, to a tamper evident design for containers.

Containers can be constructed with various structures and sizes. Two common container structures include clamshell containers and multi-piece containers. Clamshell containers are containers that mimic the form and function of a clamshell. Clamshell containers include a base portion and a cover portion that are attached to one another with a hinge. Multi-piece containers are containers that include a base portion and a cover portion that are separate pieces designed to fit together. Typically, both clamshell containers and multi-piece containers have some form of closure that is capable of holding the cover portion on the base portion when the container is closed. Different types of closures can be used, including self-locking tabs, snaps, or screw tops. Containers can also be held together with means other than closures. These means can include using frictional forces to hold container pieces together, heat sealing the container pieces together, or using staples, adhesives, or labels to hold the container pieces together.

Containers are typically secured using standard closures that allow a user to open and close the container with no consequence. Containers can also be secured with tamper evident or tamper proof closures. These types of closures include a feature that will make it obvious that the container has been opened. A container with a tamper evident or a tamper proof closure will be irreversibly altered when the container is opened for the first time.

SUMMARY

A tamper evident closure includes a first snap, a cover, a tear strip connected to the cover, and a second snap connected to the tear strip. In a closed position, a cavity of the cover is configured to be placed over the first snap, and the second snap is configured to be placed in and engaged with a cavity in the first snap. In a closed position, there is a gap between the first snap and the cover.

A method includes closing a tamper evident container by bringing a first container portion into contact with a second container portion. A cavity of a cover is placed over a first snap. The cover is connected to a tear strip along a first perforated line and the tear strip is connected to a second snap along a second perforated line. There is a gap between the first snap and the cover. The second snap is folded along the second perforated line. The second snap is placed in a cavity of the first snap. The second snap engages the first snap.

DETAILED DESCRIPTION

Containers are used in many industries as a form of packaging for products that are commercially available. To indicate when someone has opened a package, some form of tamper evident or tamper proof means is used. A tamper evident indicator will indicate that the package has been opened, so that someone purchasing or using the product can ensure that the package includes all of the necessary contents and is safe to use.

Figure 1:
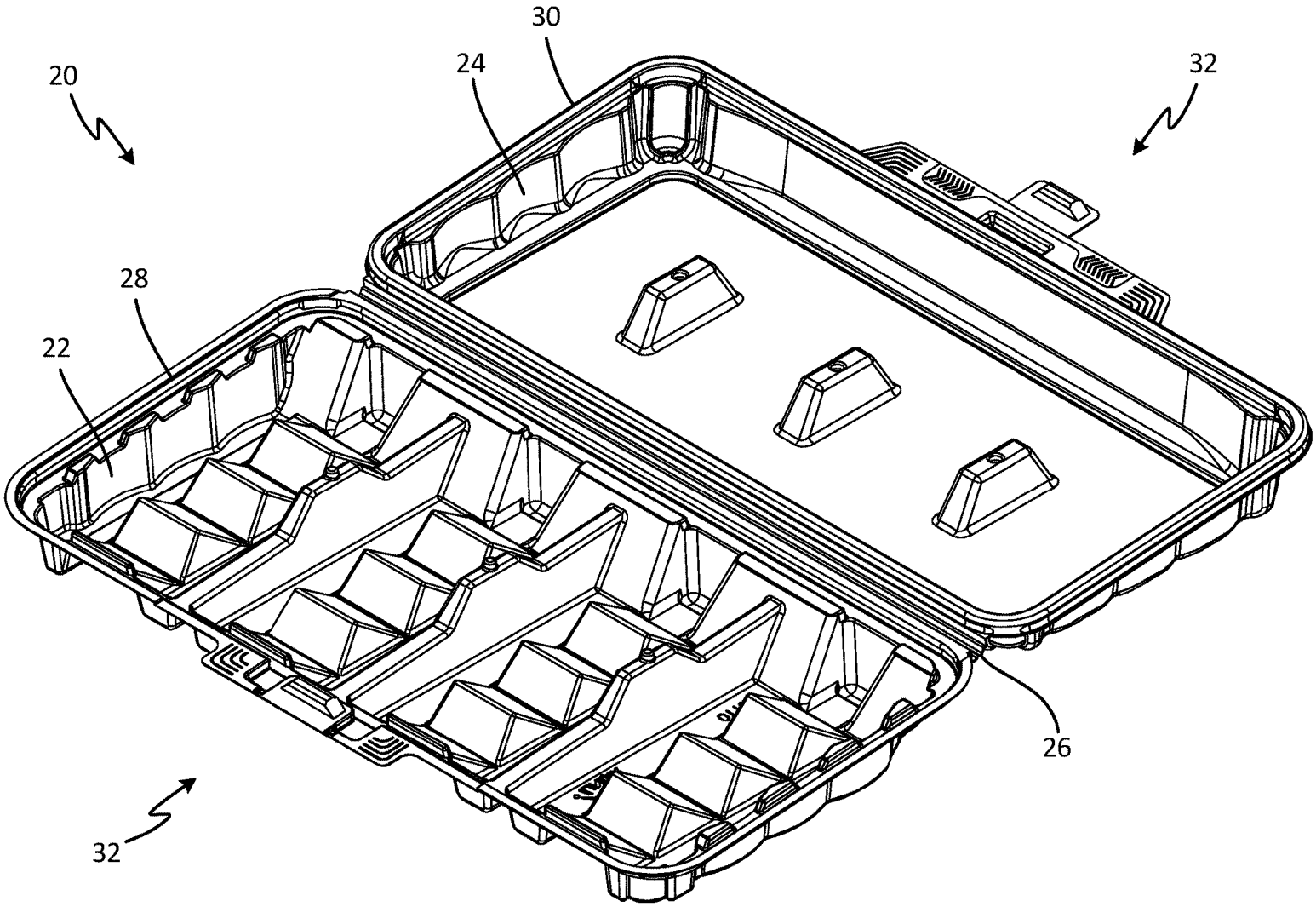
FIG. 1 is an isometric view of a tamper evident container.

FIG. 1 is an isometric view of tamper evident container 20. Tamper evident container 20 includes first container portion (base) 22, second container portion (cover) 24, hinge 26, rim 28, rim 30, and tamper evident closure 32.

Container 20 includes first container portion 22 that forms a base of container 20 and second container portion 24 that forms a cover of container 20. First container portion 22 and second container portion 24 are attached along hinge 26 in the embodiment shown, but can be separate pieces in alternate embodiments. Both first container portion 22 and second container portion 24 of tamper evident container 20 are made out of plastic in the embodiment shown, but any suitable material can be used.

First container portion 22 includes rim 28 at an upper edge. Second container portion 24 includes rim 30 at a lower edge. Rim 28 on first container portion 22 forms a seal with rim 30 on second container portion 24 when container 20 is in a closed position.

Container 20 further includes tamper evident closure 32. Tamper evident closure 32 includes a first portion on first container portion 22 and a second portion on second container portion 24. The first portion and the second portion of tamper evident closure 32 mate together when container 20 is closed and hold container 20 in the closed position. There is one tamper evident closure 32 on container 20 in the embodiment shown, but there can be any number of tamper evident closures 32 on container 20 in alternate embodiments. Further, tamper evident closures 32 may be located anywhere on container 20.

Tamper evident closure 32 creates a container that is tamper evident. To open tamper evident container 20, a user must grab and pull a tear strip on tamper evident closure 32 away from and remove it from tamper evident container 20. When the tear strip has been removed from tamper evident container 20, a user knows that tamper evident container 20 has been opened. Once the tear strip is removed from tamper evident container 20, a user can open and close tamper evident container 20 by attaching and detaching second container portion 24 from first container portion 22 by sealing and unsealing rim 28 on first container portion 22 with rim 30 on second container portion 24. Tamper evident container 20 can be opened and closed many times, even if tamper evident container 20 will no longer have tamper evident features after it is opened for the first time.

Figure 2A:
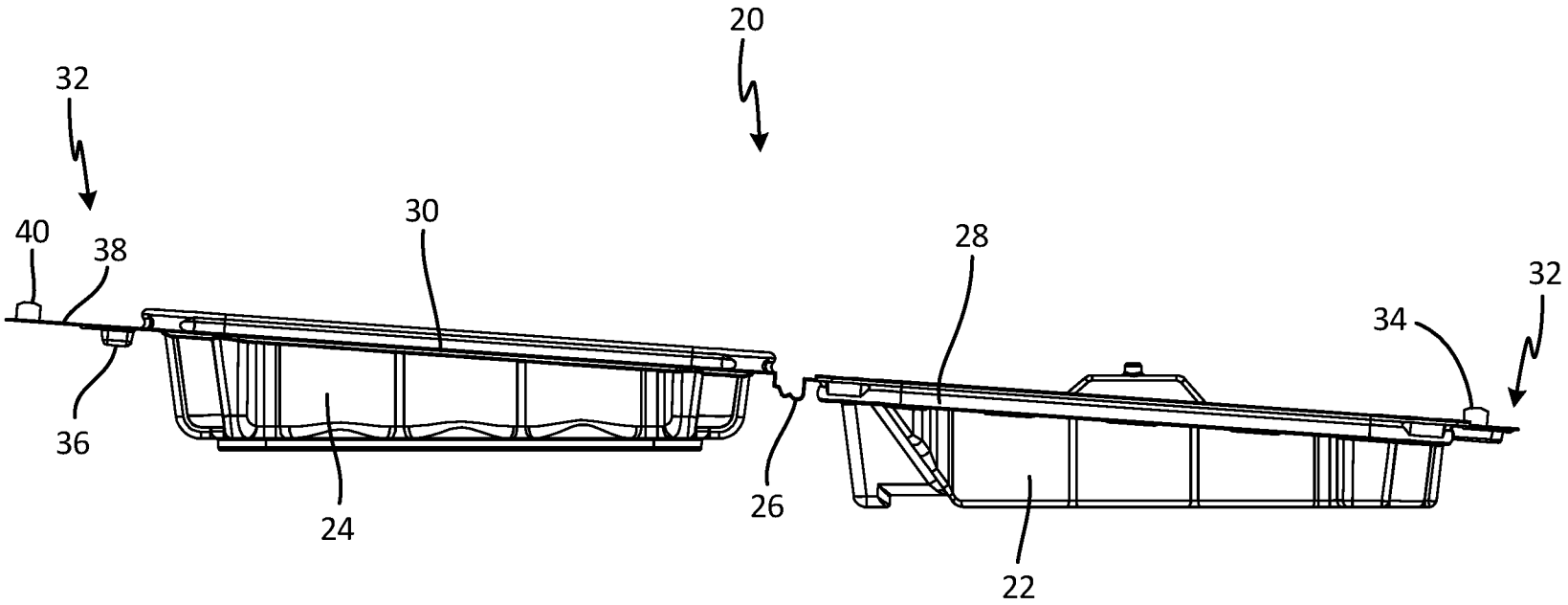
FIG. 2A is a side elevation view of the tamper evident container of FIG. 1 in an open position.
Figure 2B:
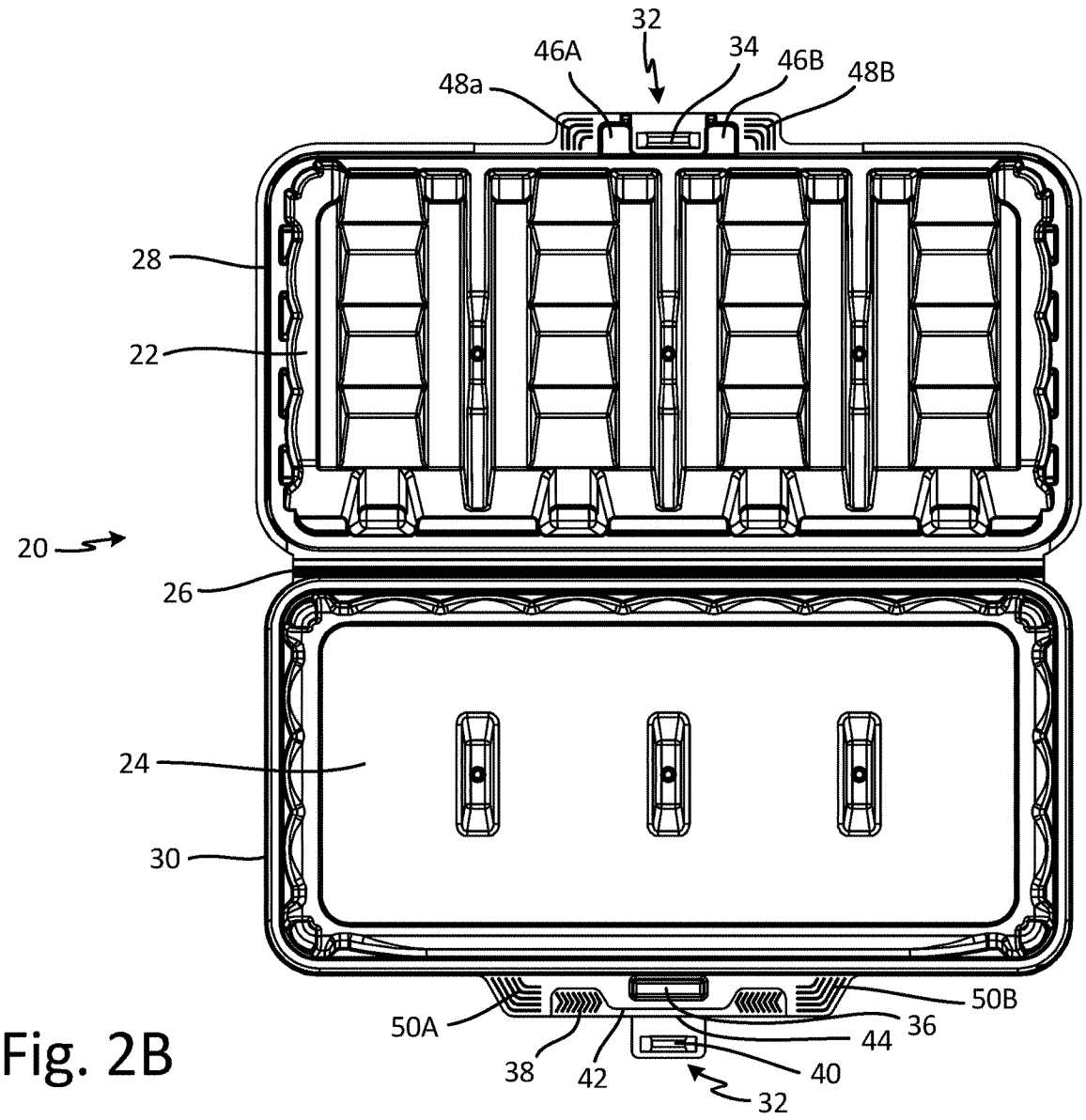
FIG. 2B is a top plan view of the tamper evident container of FIG. 1 in an open position.

FIGS. 2A-2B show tamper evident container 20 in an open position. FIG. 2A is a side elevation view of tamper evident container 20 in an open position. FIG. 2B is a top plan view of tamper evident container 20 in an open position. Tamper evident container 20 includes first container portion 22, second container portion 24, hinge 26, rim 28, rim 30, and tamper evident closure 32. Tamper evident closure 32 includes first snap 34, cover 36, tear strip 38, second snap 40, perforated line 42, perforated line 44, projections 46A and 46B, tabs 48A and 48B, and tabs 50A and 50B.

Container 20 includes first container portion 22 that forms a base of container 20 and second container portion 24 that forms a cover of container 20. First container portion 22 and second container portion 24 are attached along hinge 26. First container portion 22 includes rim 28 at an upper edge. Second container portion 24 includes rim 30 at a lower edge. Rim 28 on first container portion 22 forms a seal with rim 30 on second container portion 24 when container 20 is in a closed position. Tamper evident container 20 is made out of plastic in the embodiment shown, but any suitable material can be used.

Container 20 further includes tamper evident closure 32. First container portion 22 includes first snap 34 and second container portion 24 includes cover 36, tear strip 38, and second snap 40. First container portion 22 is integrally formed with first snap 34. First snap 34 has a substantially rectangular shape and projects upwards from container 20. First snap 34 has a cavity formed on the inside of the upward projection that can be accessed on the bottom side of container 20. In alternate embodiments, first snap 34 can have any shape, including but not limited to, a square shape, a circular shape, or an oval shape. In further alternate embodiments, first snap 34 can be an opening.

Second container portion 24 is integrally formed with cover 36. Cover 36 is attached to tear strip 38 along perforated line 42. Second snap 40 is attached to tear strip 38 along perforated line 44. Cover 36 has a substantially rectangular shape and projects downwards from container 20. Cover 36 has a cavity formed on the inside of the downward projection that can be accessed on the top side of container 20. Second snap 40 has a substantially rectangular shape and projects upwards from container 20. Second snap 40 has a cavity formed on the inside of the upward projection that can be accessed on the bottom side of container 20. In alternate embodiments, cover 36 and second snap 40 can have any shape, including but not limited to, a square shape, a circular shape, or an oval shape.

Tamper evident closure 32 is formed by fitting first snap 34, cover 36, tear strip 38, and second snap 40 together. When tamper evident container 20 is in a closed position, tamper evident closure 32 is located on a front of tamper evident container 20. In alternate embodiments, tamper evident closure 32 may be located on any side of container 20. In further alternate embodiments, container 20 can include a plurality of tamper evident closures 32 that can be located on any side of container 20.

When tamper evident container 20 is in a closed position, tamper evident closure 32 is positioned so that tear strip 38 faces upwards from tamper evident closure 32. Perforated line 42 and perforated line 44 are lines that run along a first side and a second side of tear strip 38. Perforated line 42 and perforated line 44 can be made from perforations of any suitable size. Tear strip 38 has a narrow middle section with bigger tabs on opposite ends of the narrow middle section. The bigger tabs on opposite ends of tear strip 38 make it easy for a user to grasp tear strip 38 on either end to pull tear strip 38 away from container 20. In alternate embodiments, tear strip 38 can have alternate shapes.

First container portion 22 also includes projections 46A and 46B and tabs 48A and 48B that are integrally formed with first container portion 22. Projection 46A is positioned on a first side of first snap 34, and projection 46B is positioned on a second side of first snap 34. Projections 46A and 46B have a substantially rectangular shape and extend downwards from container 20. Projections 46A and 46B have a cavity formed on the inside of the downward projections that can be accessed on the top side of container 20. Tab 48A is positioned adjacent to projection 46A on a first side of first snap 34, and tab 48B is positioned adjacent to projection 46B on a second side of first snap 34. After tear strip 38 is removed from container 20, tabs 48A and 48B can be grasped to separate first container portion 22 and second container portion 24 to open container 20.

Second container portion 24 includes tabs 50A and 50B that are integrally formed with second container portion 24. Tab 50A is positioned adjacent to a first end of tear strip 38 on a first side of cover 36, and tab 50B is positioned adjacent to a second end of tear strip 38 on a second side of cover 36. Tabs 48A and 48B can be grasped by a user to hold container 20 in place when a user is pulling tear strip 38 off of container 20. After tear strip 38 is removed from container 20, tabs 48A and 48B can be grasped to separate first container portion 22 and second container portion 24 to open container 20.

To open tamper evident container 20, a user can grab tear strip 38 between his/her fingers and pull it away from tamper evident container 20. Tear strip 38 is attached to cover 36 and second snap 40 along perforated line 42 and perforated line 44, respectively. When tear strip 38 is pulled away from tamper evident container 20, perforated line 42 and perforated line 44 separate so that tear strip 38 can be removed from tamper evident container 20. Once tear strip 38 is removed, tamper evident closure 32 can be opened.

Tamper evident closure 32 creates a container that is tamper evident. To open tamper evident container 20, a user must grab tear strip 38 and pull it away and remove it from tamper evident container 20. When tear strip 38 has been removed from tamper evident container 20, a user knows that tamper evident container 20 has been opened. Once tear strip 38 is removed from tamper evident container 20, a user can open tamper evident closure 32 and container 20. Container 20 can be then closed and opened again by sealing and unsealing rim 28 of first container portion 22 with rim 30 of second container portion 24. This allows a user to open and close tamper evident container 20 many times, even if tamper evident container 20 will no longer have tamper evident features after it is opened for the first time.

Tamper evident closure 32 is simple and intuitive to use. This makes tamper evident closure 32 advantageous, as users do not need to be trained or instructed on how to use tamper evident closure 32. Tamper evident container 20 can be assembled by hand, which allows someone to use the container to package his or her own products. Tamper evident container 20 can also be assembled automatically, thus making tamper evident container 20 suitable for use in large manufacturing operations. Tamper evident container 20 can be used in a variety of different ways. First, tamper evident container 20 can be used to package food. Having a tamper evident package for food is advantageous, as consumers can ensure that the food has not been tampered with prior to purchasing it. Second, tamper evident container 20 can be used to package products. Having a tamper evident package for products can ensure consumers that all of the parts are in the package and that the product has not been tampered with prior to purchasing it.

Tamper evident container 20 is manufactured in the open position, as seen in FIGS. 2A-2B. Tamper evident container 20 is manufactured using common container and packaging manufacturing techniques. Manufacturing tamper evident container 20 in the open position allows tamper evident containers 20 to be stacked in a substantially flat manner for shipping. This allows multiple containers to be shipped in a single box, which saves space and cost. Being able to stack tamper evident container 20 while it is in the open position also saves space when storing tamper evident container 20.

Figure 3A:
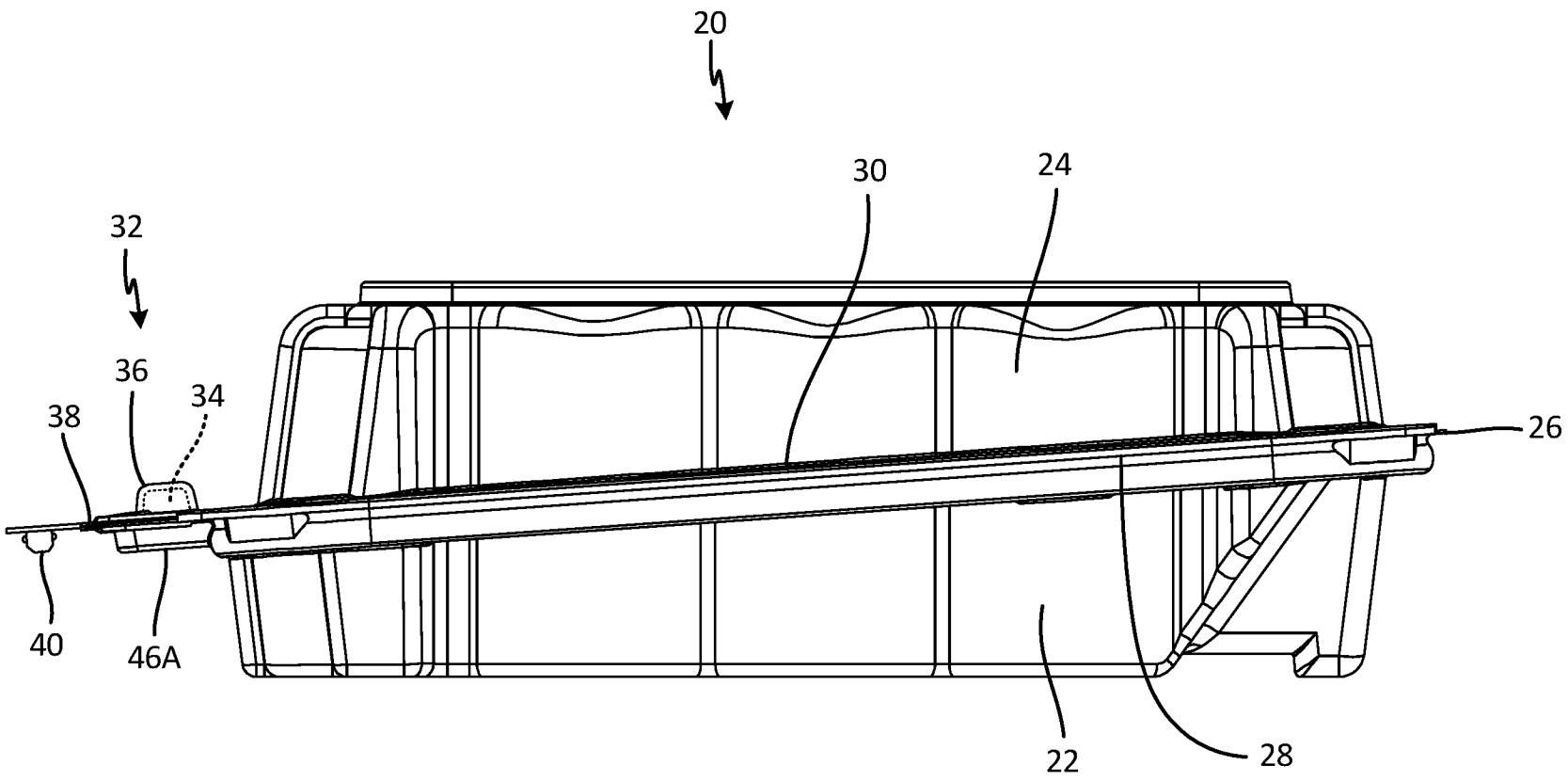
FIG. 3A is a side elevation view of the tamper evident container of FIG. 1 in a partially closed position.
Figure 3B:
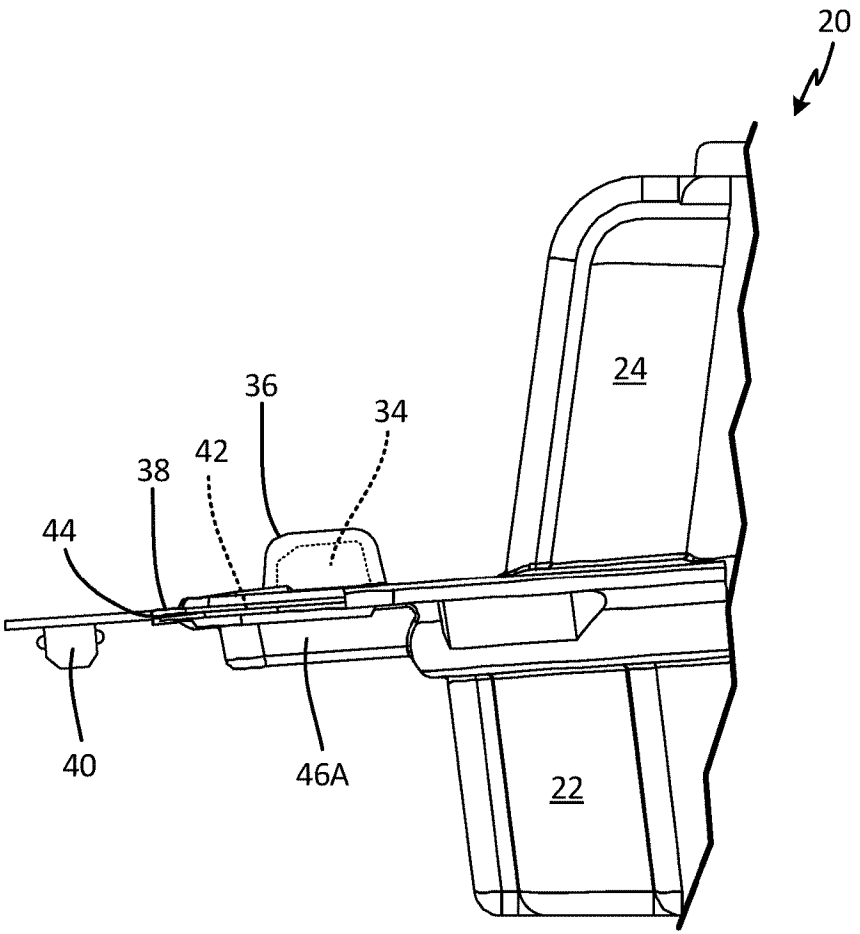
FIG. 3B is a side elevation view of a portion of the tamper evident container of FIG. 1 in a partially closed position.

FIGS. 3A-3B show tamper evident container 20 in a partially closed position. FIG. 3A is a side elevation view of tamper evident container 20 in a partially closed position. FIG. 3B is a side elevation view of a portion of tamper evident container 20 in a partially closed position. Tamper evident container 20 includes first container portion 22, second container portion 24, hinge 26, rim 28, rim 30, and tamper evident closure 32. Tamper evident closure 32 includes first snap 34, cover 36, tear strip 38, second snap 40, perforated line 42, perforated line 44, projections 46A and 46B (projection 46B not shown in FIGS. 3A-3B), tabs 48A and 48B (not shown in FIGS. 3A-3B), and tabs 50A and 50B (not shown in FIGS. 3A-3B).

First container portion 22 is connected to second container portion 24 along hinge 26. In a partially closed position, rim 28 of first container portion 22 is sealed with rim 30 of second container portion 24.

Further in a partially closed position, the cavity of cover 36 can be placed over first snap 34. Cover 36 is sized to be larger than first snap 34 so that first snap 34 and cover 36 will not abut one another when cover 36 is placed over first snap 34. There will be a gap between first snap 34 and cover 36 when cover 36 is placed over first snap 34. In this manner, cover 36 sits around first snap 34 but does not form a seal with first snap 34. Cover 36 prevents a user from accessing first snap 34.

Figure 4A:
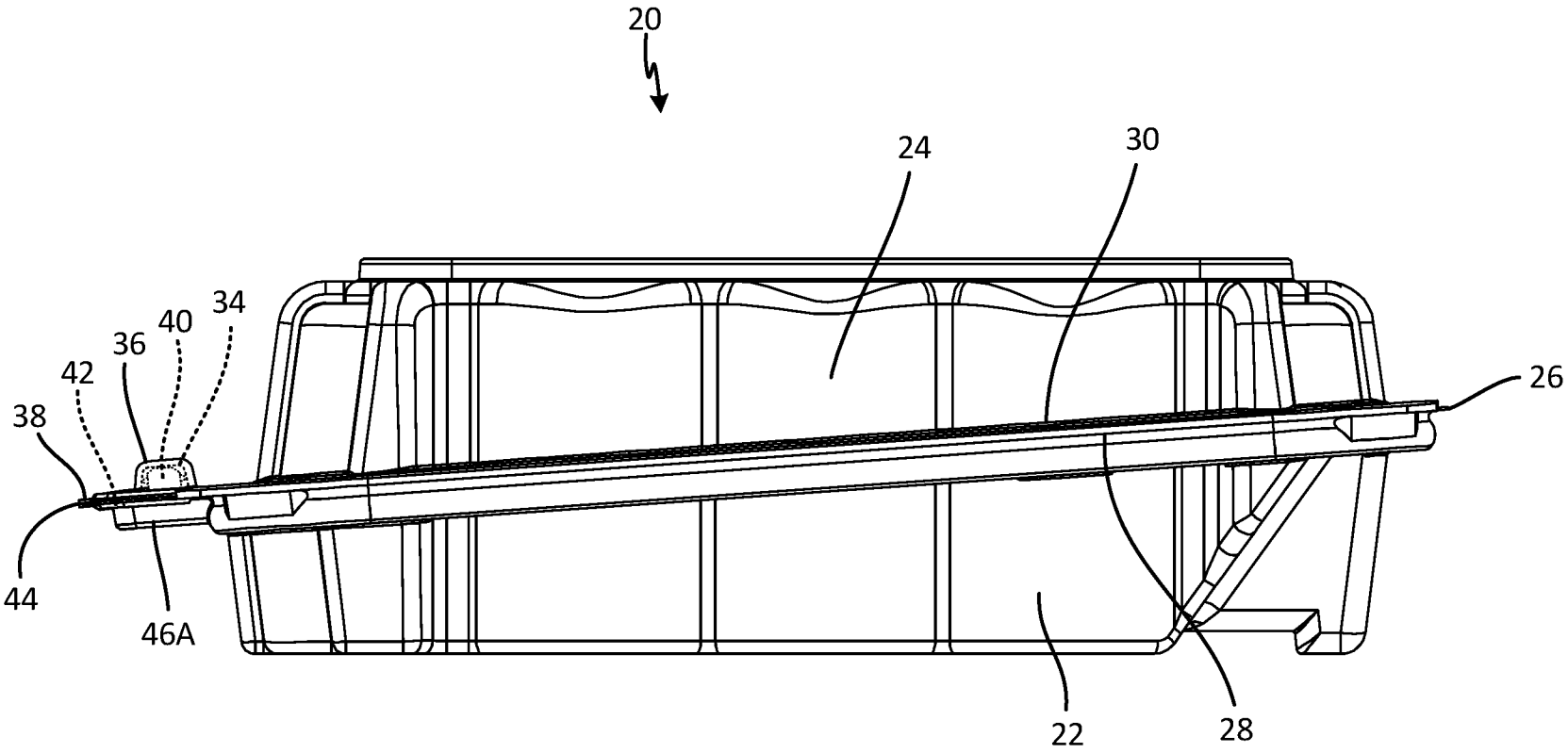
FIG. 4A is a side elevation view of the tamper evident container of FIG. 1 in a closed position.
Figure 4B:
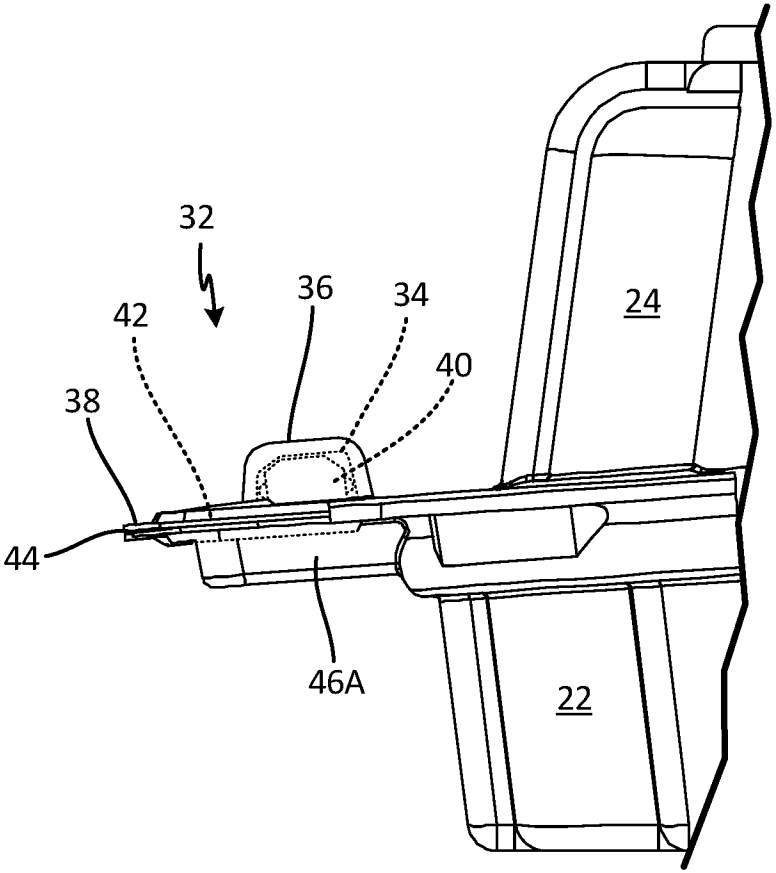
FIG. 4B is a side elevation view of a portion of the tamper evident container of FIG. 1 in a closed position.

FIGS. 4A-4B show tamper evident container 20 in a closed position. FIG. 4A is a side elevation view of tamper evident container 20 in a closed position. FIG. 4B is a side elevation view of a portion of tamper evident container 20 in a closed position. Tamper evident container 20 includes first container portion 22, second container portion 24, hinge 26, rim 28, rim 30, and tamper evident closure 32. Tamper evident closure 32 includes first snap 34, cover 36, tear strip 38, second snap 40, perforated line 42, perforated line 44, projections 46A and 46B (projection 46B not shown in FIGS. 4A-4B), tabs 48A and 48B (not shown in FIGS. 4A-4B), and tabs 50A and 50B (not shown in FIGS. 4A-4B).

To fully close tamper evident container 20, second snap 40 can be folded and placed in the cavity of first snap 34. Second snap 40 is folded along perforated line 44. Second snap 40 is designed to have a tight fit with the cavity of first snap 34 so that there are no voids between the two snaps when tamper evident container 20 is closed. Having a tight fit between second snap 40 and first snap 34 makes it very difficult, if not impossible, for tamper evident container 20 to be opened without permanently altering tamper evident closure 32 or tamper evident container 20.

Placing second snap 40 in first snap 34 leaves tear strip 38 facing upwards from tamper evident container 20. To remove tear strip 38, a user can grab either end of tear strip 38 and pull tear strip 38 outwards and away from tamper evident container 20. When tear strip 38 is pulled away from tamper evident container 20, perforated line 42 and perforated line 44 break apart. This allows for the easy removal of tear strip 38. Once tear strip 38 is removed, tamper evident closure 32 can be opened when tamper evident container 20 is opened. Second snap 40 remains in the cavity of first snap 34 when tamper evident closure 32 is opened.

Second snap 40 is designed to fit tightly in first snap 34 with no voids so that tamper evident container 20 cannot be opened without first removing tear strip 38. The tight fit between second snap 40 and first snap 34 reduces the potential of someone being able to open the container with a sharp or pointed object. It also reduces the potential of someone being able to open tamper evident container 20 without first removing tear strip 38. Further, when second snap 40 is folded and placed in first snap 34, projections 46A and 46B and first container portion 22 surround edges of second snap 40. Projections 46A and 46B and first container portion 22 prevent a user from prying second snap 40 out of first snap 34, as it is very difficult, if not impossible, to grasp an edge of second snap 40. Additionally, cover 36 is positioned over first snap 34 and second snap 40 when container 20 is in a closed position. Cover 36 is sized to be larger than first snap 34 to prevent a user from being able to tamper with the fit between first snap 34 and second snap 40 to disengage second snap 40 from first snap 34.

Tamper evident closure 32 is a closure that can be closed for the first time by a user to create a tamper evident seal. After it is opened for the first time and tear strip 38 is removed, tamper evident container 20 can be opened and closed an infinite number of times by sealing and unsealing rim 28 on first container portion 22 with rim 30 on second container portion 24. Tamper evident closure 32 is advantageous for this reason, as it allows a user to utilize a tamper evident closure on a container while allowing the container to be opened and closed an infinite number of times after it is opened for the first time. Tamper evident container 20 is permanently altered when tear strip 38 is removed, but the permanent alteration does not prevent a user for opening and closing the container after that point.

Figure 5:
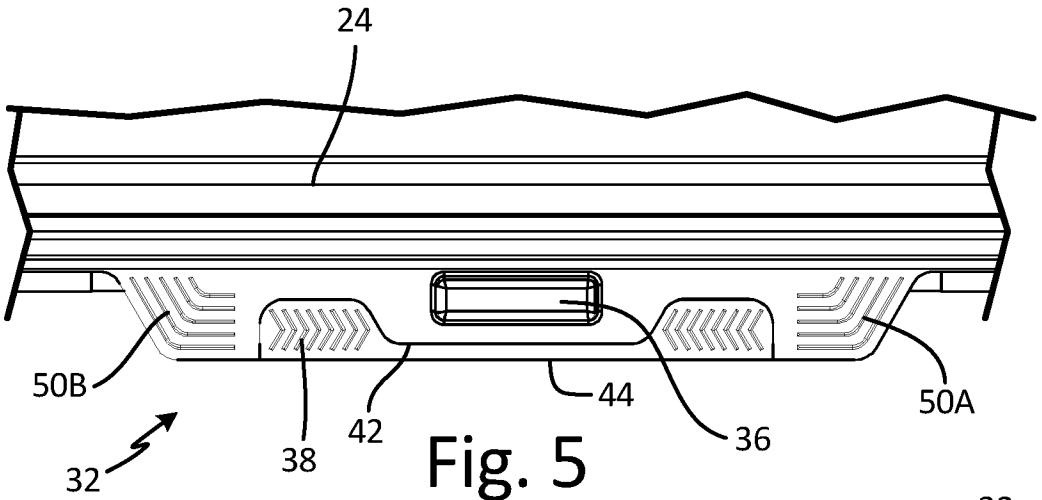
FIG. 5 is a top view of a tamper evident closure.
Figure 6:
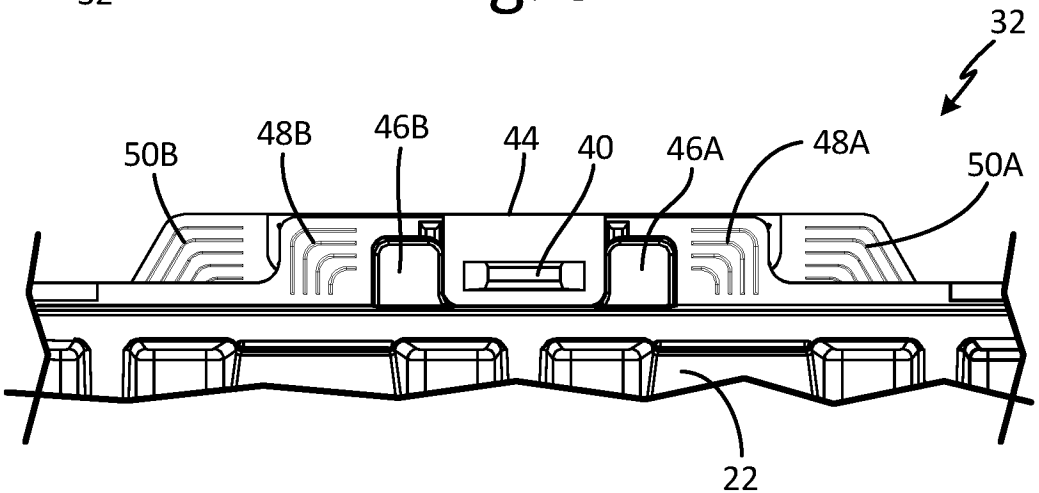
FIG. 6 is a bottom view of the tamper evident closure shown in FIG. 5.

FIG. 5 is a top view of tamper evident closure 32. FIG. 6 is a bottom view of tamper evident closure 32. Tamper evident closure 32 includes first snap 34, cover 36, tear strip 38, second snap 40, perforated line 42, perforated line 44, projections 46A and 46B, tabs 48A and 48B, and tabs 50A and 50B.

As seen in FIG. 5, when tamper evident closure 32 is in a closed position, tear strip 38 faces upwards from container 20. A user can grasp tear strip 38 on either a first end or a second end of tear strip 38 and remove tear strip 38 from tamper evident container 20. Tear strip 38 will separate along perforated line 42 and perforated line 44. Tabs 50A and 50B are positioned on a first side and a second side of cover 36. One of tabs 50A and 50B can be grasped buy a user to hold onto tamper evident container 20 when tear strip 38 is pulled off of tamper evident container 20.

As seen in FIG. 6, tabs 48A and 48B are positioned on a first side and a second side of second snap 40. Once tear strip 38 has been removed, a user can grasp one of tabs 48A and 48B and one of tabs 50A and 50B to separate rim 28 of first container portion 22 from rim 30 of second container portion 24 to open container 20.

As further seen in FIG. 6, when tamper evident closure 32 is in a closed positioned, projection 46A surrounds a first edge of second snap 40 and projection 46B surrounds a second edge of second snap 40 that is opposite of the first edge. Further, a portion of first container portion 22 of container 20 surrounds a third edge of second snap 40 between the first edge and the second edge. Projections 46A and 46B and first container portion 22 prevent a user from prying second snap 40 out of first snap 34, as it is very difficult, if not impossible, to grasp an edge of second snap 40. Further, even if a user were able to grasp an edge of second snap 40, perforated line 44 would tear when trying to remove second snap 40 from first snap 34. This would indicate to a user that container 20 has been tampered with.

In the embodiment shown, tamper evident container 20 is a clamshell container with first container portion 22 connected to second container portion 24 along hinge 26. In alternate embodiments, tamper evident container 20 can be a multi-piece container. Further, in alternate embodiments, the number of tamper evident closures can vary and can include more than one tamper evident closure. Additionally, the size, shape, and placement of the tamper evident closures can vary depending on the structure of the container.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tamper evident container comprising:

a first container portion;

a second container portion;

a tamper evident closure that comprises:

a first snap connected to the first container portion;

a tear strip connected to the second container portion; and a second snap connected to the tear strip;

wherein when the tamper evident closure is in a closed position, the second snap is configured to be placed in and engaged with a cavity in the first snap;

a first projection positioned on a first side of the first snap;

a second projection positioned on a second side of the first snap; and an edge surrounding container portion extending generally between the first projection and the second projection;

wherein when the tamper evident closure is in a closed position, the first projection is configured to abut a first side of the second snap, the second projection is configured to abut a second side of the second snap, and the edge surrounding container portion is configured to abut a third side of the second snap; and wherein when the tamper evident container is in a closed position, the tamper evident container is configured to prevent a user from accessing the first snap.

2. The tamper evident container of claim 1, wherein when the tamper evident closure is in a closed position, the second snap has a tight fit with the cavity of the first snap and cannot be removed from the cavity of the first snap.

3. The tamper evident container of claim 1, and further comprising:

a first perforated line connecting the second container portion to the tear strip; and a second perforated line connecting the tear strip to the second snap.

4. The tamper evident container of claim 3, wherein the tear strip is configured to be removed from the tamper evident closure by separating the tear strip along the first perforated line and the second perforated line.

5. The tamper evident container of claim 4, wherein when the tear strip is removed from the tamper evident closure, the tamper evident closure can be opened.

6. The tamper evident container of claim 1, and further comprising:

a first tab on a first side of the first snap; and a second tab on a second side of the first snap.

7. The tamper evident container of claim 6, wherein the first tab and the second tab are configured to be grasped by a user to pull the tear strip off of the tamper evident closure.

8. The tamper evidence container of claim 1, and further comprising:

a cover connected to the second container portion and the tear strip;

wherein when the tamper evident closure is in a closed position, a cavity of the cover is configured to be placed over the first snap; and wherein when the tamper evident closure is in a closed position, there is a gap between the first snap and the cover.

9. The tamper evident container of claim 8, wherein when the tamper evident closure is in a closed position, the cover is configured to prevent a user from accessing the first snap.

10. The tamper evident container of claim 8, and further comprising:

a third tab on a first side of the cover; and a fourth tab on a second side of the cover.

11. The tamper evident container of claim 10, wherein the third tab and the fourth tab are configured to be grasped by a user to open a tamper evident container to which the tamper evident closure is attached.

12. The tamper evident container of claim 1, wherein the first container portion and the second container portion are attached with a hinge.

13. The tamper evident container of claim 1, wherein the first container portion and the second container portion are two separate pieces.

* * * * *